US009794699B2

(12) United States Patent
Choi et al.

(10) Patent No.: US 9,794,699 B2
(45) Date of Patent: Oct. 17, 2017

(54) HEARING DEVICE CONSIDERING EXTERNAL ENVIRONMENT OF USER AND CONTROL METHOD OF HEARING DEVICE

(71) Applicant: Samsung Electronics Co., Ltd., Suwon-si (KR)

(72) Inventors: Jong Min Choi, Seoul (KR); Yun Seo Ku, Seoul (KR); Dong Wook Kim, Seoul (KR); Jong Jin Kim, Hwaseong-si (KR); Jun Il Sohn, Yongin-si (KR); Jun Whon Uhm, Anyang-si (KR); Heun Chul Lee, Pocheon-si (KR); Yoon Chae Cheong, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 219 days.

(21) Appl. No.: 14/103,218

(22) Filed: Dec. 11, 2013

(65) Prior Publication Data

US 2014/0169574 A1 Jun. 19, 2014

(30) Foreign Application Priority Data

Dec. 13, 2012 (KR) ..... 10-2012-0145615

(51) Int. Cl.
*H04R 25/00* (2006.01)

(52) U.S. Cl.
CPC ..... *H04R 25/43* (2013.01); *H04R 25/505* (2013.01); *H04R 2225/41* (2013.01); *H04R 2225/61* (2013.01)

(58) Field of Classification Search
CPC .. H04R 25/43; H04R 25/505; H04R 2225/41; H04R 2225/61
See application file for complete search history.

(56) References Cited

U.S. PATENT DOCUMENTS

| | | | | |
|---|---|---|---|---|
| 6,320,969 | B1 | 11/2001 | Killion | |
| 6,978,155 | B2 | 12/2005 | Berg | |
| 2002/0044669 | A1* | 4/2002 | Meyer | H04R 25/558 381/314 |
| 2004/0052391 | A1* | 3/2004 | Bren | H04R 25/43 381/331 |
| 2005/0141737 | A1* | 6/2005 | Hansen | H04R 25/70 381/316 |

(Continued)

FOREIGN PATENT DOCUMENTS

| | | | |
|---|---|---|---|
| JP | 9-18997 | A | 1/1997 |
| JP | 2008-42787 | A | 2/2008 |

(Continued)

*Primary Examiner* — Ping Lee
(74) *Attorney, Agent, or Firm* — NSIP Law

(57) ABSTRACT

A hearing device and a method of the hearing aid are provided considering an external environment surrounding a user. The hearing device includes an external environment determination unit, an inquiry unit, and a parameter set unit. The external environment determination unit is configured to determine an external environment surrounding a user wearing the hearing device. The inquiry unit is configured to select a question corresponding to the external environment and inquire the question to the user. The parameter set unit is configured to set a parameter of the hearing device based on a response to the question and hearing loss information of the user.

15 Claims, 8 Drawing Sheets

(56) References Cited

U.S. PATENT DOCUMENTS

| | | | | |
|---|---|---|---|---|
| 2007/0230726 | A1* | 10/2007 | Giesner et al. | 381/312 |
| 2011/0051963 | A1* | 3/2011 | Barthel | H04R 25/70 381/314 |
| 2011/0235835 | A1* | 9/2011 | Bulow et al. | 381/314 |
| 2013/0022223 | A1* | 1/2013 | Kehtarnavaz | H04R 25/70 381/317 |

FOREIGN PATENT DOCUMENTS

| | | | |
|---|---|---|---|
| JP | 2010-34949 | A | 2/2010 |
| JP | 2010-239603 | A | 10/2010 |
| KR | 10-2001-0008008 | A | 2/2001 |
| KR | 10-2004-0019147 | A | 3/2004 |
| KR | 10-2010-0042370 | A | 4/2010 |
| KR | 10-2011-0079846 | A | 7/2011 |
| KR | 10-2011-0097530 | A | 8/2011 |

* cited by examiner

HEARING DEVICE CONSIDERING EXTERNAL ENVIRONMENT OF USER AND CONTROL METHOD OF HEARING DEVICE

CROSS-REFERENCE TO RELATED APPLICATION(S)

This application claims the benefit under 35 USC §119(a) of Korean Patent Application No. 10-2012-0145615, filed on Dec. 13, 2012, in the Korean Intellectual Property Office, the entire disclosure of which is incorporated herein by reference for all purposes.

BACKGROUND

1. Field

The following description relates to a hearing device and a control method of the hearing device, and more particularly, to setting of parameters of a hearing device taking into consideration an external environment surrounding a user.

2. Description of Related Art

A hearing device amplifies a sound generated from an outside source and helps a user perceive the sound. In general, hearing devices are built in different shapes and sizes including a pocket type, an earring type, a concha type, and an eardrum type. The hearing device may deliver a sound as desired by the user by varying one or more settings of the hearing device such as volume control and frequency control. In one example, the hearing device measures hearing ability of the user and sets an optimal setting for the hearing device.

However, as the user moves around and the hearing device is exposed to different environments, including different places and time, parameters of the hearing device needs to be changed. Furthermore, the user may need a dedicated device to vary the settings of the hearing device. However, a settings change device may be so complicated to operate or use making it difficult for the user to operate, and requiring a skilled engineer to operate.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In accordance with an illustrative example, there is provided a hearing device, including an external environment determination unit configured to determine an external environment surrounding a user wearing the hearing device; an inquiry unit configured to select a question corresponding to the external environment and inquire the question to the user; and a parameter set unit configured to set a parameter of the hearing device based on a response to the question and hearing loss information of the user.

The external environment may include at least one of oscillation frequency, frequency, and electronic waves generated in the external environment surrounding the user.

The external environment determination unit may be configured to determine the external environment surrounding the user using an audio sensor and a radio wave sensor included in the hearing device.

The inquiry unit may include a question list including questions corresponding to the external environment surrounding the user.

The inquiry unit may be configured to select the question considering sound distortions due to influences caused by at least one of a user gender, a user age, a time zone at which the external environment surrounding the user is determined, a season, a weather, and an external temperature.

The inquiry unit may be configured to select a question to connect to an electronic device disposed in the external environment surrounding the user according to intensity of radio waves detected through the electronic device.

The inquiry unit may be configured to inquire the selected question to the user through a user terminal connected to the hearing device or to an audio sensor or a touch sensor included in the hearing device, and to receive the response to the question.

The parameter set unit may be configured to set the parameter of the hearing device based on at least one of volume control, equalizer control, volume control at a particular frequency band, noise control, reverberation control, wind noise control, acoustic feedback control, microphone power control, connection to an electronic device, and preset.

In accordance with an illustrative example, there is provided a method for a hearing device, including determining an external environment surrounding a user wearing the hearing device; selecting a question corresponding to the external environment and inquiring the question to the user; and setting a parameter of the hearing device based on a response to the question and hearing loss information of the user.

The external environment may include at least one of oscillation frequency, frequency, and electronic waves generated in the external environment surrounding the user.

The determining of the external environment may include determining the external environment surrounding the user using an audio sensor and a radio wave sensor included in the hearing device.

The selecting and inquiring of the question may include a question list including questions corresponding to the external environment surrounding the user.

The selecting and inquiring of the question may include selecting the question considering sound distortions due to influences caused by at least one of a user gender, a user age, a time zone at which the external environment surrounding the user is determined, a season, a weather, and an external temperature.

The selecting and inquiring of the question may include selecting a question to connect to an electronic device disposed in the external environment surrounding the user according to intensity of radio waves detected through the electronic device.

The selecting and inquiring of the question may include inquiring the selected question to the user through a user terminal connected to the hearing device or to an audio sensor or a touch sensor included in the hearing device, and to receive the response to the question.

The setting of the parameter may include setting the parameter of the hearing device based on at least one of volume control, equalizer control, volume control at a particular frequency band, noise control, reverberation control, wind noise control, acoustic feedback control, microphone power control, connection to an electronic device, and preset.

A non-transitory computer readable medium configured to control a processor to perform the method described above.

In accordance with an illustrative example, there is provided a hearing device, including an external environment determination unit configured to determine an external environment surrounding a user; an inquiry unit configured to search for a question corresponding to the external environment, and receive a response to the question from the user through a sensor included in the hearing device; and a parameter set unit configured to set a parameter related to the external environment and corresponding to the response received from the user.

The parameter may include at least one of volume control, equalizer control, control of a particular frequency band, noise control, reverberation control, wind noise control, acoustic feedback control and is set based on the response of the user and hearing loss information of the user.

The external environment determination unit may be configured to use at least one of a touch sensor, an audio sensor, an acceleration sensor, a temperature sensor, an optical sensor, and a radio wave sensor to determine the external environment surrounding the user.

The inquiry unit may be configured to store in a database a question list including the question corresponding to the external environment.

The sensor may include an audio sensor, an acceleration sensor, a radio wave sensor, a temperature sensor, an optical sensor.

The inquiry unit may select the question corresponding to the external environment of the user, taking into consideration sound distortions due to at least one of time zone, weather, and season defining the external environment surrounding the user.

Other features and aspects will be apparent from the following detailed description, the drawings, and the claims.

BRIEF DESCRIPTION OF THE DRAWINGS

These and/or other aspects will become apparent and more readily appreciated from the following description of the embodiments, taken in conjunction with the accompanying drawings in which.

Figure 1:
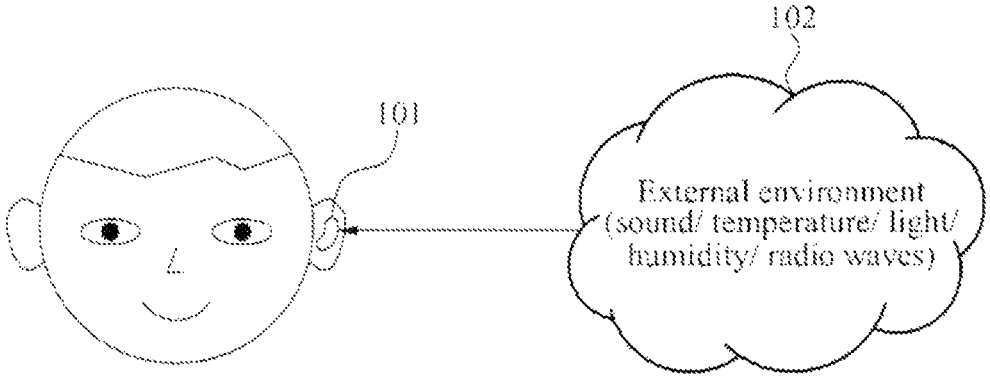
FIG. 1 is a diagram illustrating operation of a hearing device, in accord with an embodiment.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses, and/or methods described herein will be suggested to those of ordinary skill in the art. The progression of processing steps and/or operations described is an example; however, the sequence of steps and/or operations is not limited to that set forth herein and may be changed as is known in the art, with the exception of steps and/or operations necessarily occurring in a certain order. Also, description of well-known functions and constructions may be omitted for increased clarity and conciseness.

FIG. 1 illustrates an operation of a hearing device 101, in accord with an embodiment.

Referring to FIG. 1, to ensure that the hearing device 101 works at its optimum capacity, the hearing device 101 considers certain factors, such as hearing ability of a user assessed through predefined questions and an external environment at which the user is located, to define parameters to use during operation. Thus, the hearing device 101 determines an external environment 102 of a user. In one illustrative example, the external environment 102 of the user includes various environmental factors that may exist at a location of the user. For example, the hearing device 101 determines the external environment 102 through sound, acceleration, external temperature, light, humidity, radio waves, and vibrations. The hearing device 101 may be a device adapted to transmit sound, such as a hearing aid, an earphone, a headset, and a microphone. In addition, the hearing device 101 may be equipped with an artificial intelligence (AI) function that automatically analyzes and determines the external environment 102 of the user.

In response to the hearing device 101 determining the external environment 102 of the user, the hearing device 101 selects questions from a predefined question list corresponding to the external environment 102. The hearing device 101 receives a response from the user to the questions through a user terminal. The user terminal may be integrated to an audio sensor or touch sensor included in the hearing device or the hearing device. In the alternative, the user terminal may be an external device including all types of data processing devices such as a personal computer (PC), a notebook, a television (TV), an audio equipment, and mobile terminals such as a mobile phone, a tablet PC, and a personal digital assistant (PDA). Furthermore, the hearing device 101 sets the parameters of the hearing device based on the received response from the user and hearing loss information associated with the user.

The hearing device 101 determines the external environment to set the parameters according to the external environment of the user, and sets, partly or entirely, the parameters of the hearing device based on the determined external environment; thus, reducing any inconvenience for the user to set the hearing device. Also, by properly coping with external environment, which is frequently changing, the hearing device 101 provides the user with convenience. In one illustrative example, the hearing device 101 triggers the determination of the external environment and the questions dynamically, that is, automatically and without user intervention, or manually.

Figure 2:
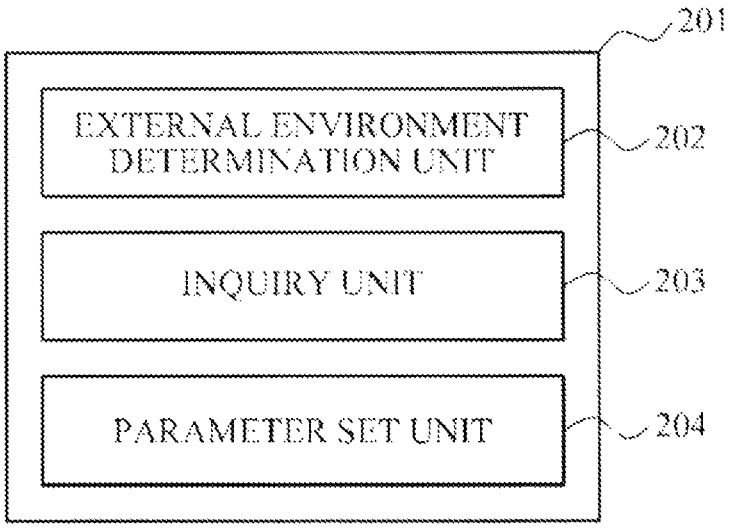
FIG. 2 is a diagram illustrating a detailed structure of the hearing device, in accord with an embodiment.

FIG. 2 illustrates a detailed structure of an example of a hearing device 201, in accord with an illustrative example.

Referring to FIG. 2, the hearing device 201 includes an external environment determination unit 202, an inquiry unit 203, and a parameter set unit 204.

In accord with an illustrative configuration, the external environment determination unit 202 determines an external environment surrounding a user. The external environment determination unit 202 uses an audio sensor included in the hearing device 201 to determine the external environment. In addition to the audio sensor, the external environment determination unit 202 also uses a touch sensor, an acceleration sensor, a temperature sensor, an optical sensor, and a radio wave sensor to determine the external environment surrounding the user. One skill in the art will appreciate that some or all of the sensors previously described may be used to determine the external environment surrounding the user.

For example, the external environment determination unit 202 determines the external environment of the user, including vehicle sounds, human voices, wind sounds, and footsteps generated at a user location.

As another example, the external environment determination unit 202 determines the external environment of the user using the audio sensor and the acceleration sensor. For instance, the external environment determination unit 202 determines the external environment by analyzing an external environment surrounding the user including, but not limited to, sounds generated outside the user and an external environment including, but not limited to, acceleration varied according to a movement of the user.

As another example, the external environment determination unit 202 determines the external environment surrounding the user using the audio sensor and the temperature sensor. For instance, the external environment determination unit 202 determines the external environment by analyzing the external environment including, but not limited to, the sounds generated outside the user and an external environment including, but not limited to, temperature varied according to morning temperature, afternoon temperature, winds, humidity, and sunlight.

As still another example, the external environment determination unit 202 determines the external environment surrounding the user using the audio sensor and the optical sensor. For instance, the external environment determination unit 202 determines the external environment by analyzing the external environment including, but not limited to, the sounds generated outside the user and an external environment including, but not limited to, light varied according to day and night, and a difference in sunshine throughout a day.

As yet another example, the external environment determination unit 202 determines the external environment surrounding the user using the audio sensor, the temperature sensor, and the optical sensor.

Also, the external environment determination unit 202 may determine the external environment surrounding the user using the audio sensor and the radio wave sensor. For instance, the external environment determination unit 202 determines the external environment by analyzing the external environment including, but not limited to, the sounds generated at the outside of the user and radio waves detected by an electronic device disposed in the external environment surrounding the user. This case will be described in detail with reference to FIG. 7.

In accord with a further illustrative configuration, the external environment determination unit 202 determines the external environment surrounding the user using oscillation frequency, frequency, and radio waves using sensors included in the hearing device 201. Furthermore, the external environment determination unit 202 may determine the external environment using light, temperature, and humidity, in addition to the sounds.

The inquiry unit 203 is configured to select questions corresponding to the external environment determined at the external environment determination unit 202. The questions may be predefined or predetermined according to the external environment surrounding the user and expressed in various meanings. The inquiry unit 203 may include a question list corresponding to a predetermined external environment. That is, the question list may be an arrangement of questions according to the external environment surrounding the user and expressed in various meanings. In one example, the question list may be stored in a database (DB) equipped at an inside or outside of the hearing device 201.

Also, the questions in the question list may be deleted, modified, or added as circumstances require. For example, when questions are added to the question list, the questions may be added to the DB including the question list. When questions of the question list are deleted, the questions may be deleted from the DB including the question list. In this case, the DB may organize contents of the question list in an order such as a predefined relevant order, alphabetically or numerical order, or an order as defined by the user.

The inquiry unit 203 selects the questions, corresponding to or to be in accord with the external environment surrounding the user, from the predetermined question list.

In one example, in response to the external environment determination unit 202 determining the external environment surrounding the user as 'noise of construction site,' the inquiry unit 203 selects questions corresponding to the 'noise of construction site' from the question list. In this case, the question list may include questions such as 'Reduce ambient sound?', 'Increase sound related to voice?', 'Remove noise of construction site and increase sound related to voice?', and the like.

In addition, the inquiry unit 203 may select the questions corresponding to the user in consideration of a user gender, a user age, a time zone at which the external environment surrounding the user is determined, a season, weather, an external temperature, and humidity according to the external environment surrounding the user. The inquiry unit 203 may select the questions corresponding to the external environment of the user, taking into consideration sound distortions due to influences caused by the time zone, the weather, the season, and the like that define the external environment surrounding the user.

In one example, the external environment determination unit 202 determines the external environment of the user as 'hot weather and high humidity.' According to the external environment determined, the external environment determination unit 202 also determines that a discomfort index of the user may be high. Accordingly, the inquiry unit 203 may select questions corresponding to the external environment from the question list. For example, the inquiry unit 203 may select a question, such as 'Attenuate amplitude of hearing device?'

Also, the inquiry unit 203 may set parameters corresponding to the external environment surrounding the user considering a sound perception level of the user as a function of the user gender, the user age, and the like. For example, in case of the user being seventy years old, the inquiry unit 203 may increase a sound volume of the hearing device, compared to a normal sound volume, when presenting the question to ensure that the user is able to hear and understand the question.

As another example, the inquiry unit 203 analyzes information including weather, such as 'fine weather', and ambient sound of the external environment. Based on the analyzed information, the inquiry unit 203 may select questions for the user in consideration of the ambient sound and the weather, the questions may include, for instance, 'The weather is fine and therefore an ambient sound is relatively small. Increase the sound volume a bit?' and 'It is windy and window noise is high. Control window noise?'

The inquiry unit 203 provides the selected questions to the user. The inquiry unit 203 transmits the questions to the user through, for example, a user terminal which is compatibly used with the audio sensor included in the hearing device 201 or with the hearing device 201. In one example, the audio sensor is adapted to provide questions dedicatedly included in the hearing device. Also, the audio sensor may be same as the audio sensor included in the hearing device to provide an external sound.

For example, the inquiry unit 203 provides the questions corresponding to the external environment surrounding the user using the audio sensor. In one example, the user may feel comfortable with the hearing device 201 by receiving the questions through the audio sensor. In addition, the hearing device 201 would enable the user to recognize a change of the external environment in real time and cope with the external environment through a state of the hearing device corresponding to the external environment.

The hearing device 201 receives a response to the questions provided through the touch sensor or the audio sensor included in the hearing device 201. To properly recognize a voice of the user and receive the response through the audio sensor, the hearing device 201 pre-stores a particular frequency corresponding to the voice of the user. Therefore, the hearing device 201 recognizes the voice of the user by comparing a frequency of a sound received through the audio sensor with the pre-stored frequency. Additionally, the hearing device 201 receives the response to the questions provided through a separate microphone connected to the hearing device 201. It will be understood that when an element or layer is referred to as being "on" or "connected to" another element, it can be directly on, operatively connected to, or connected to the other element or through intervening elements may be present. In contrast, when an element is referred to as being "directly on" or "directly connected to" another element, there are no intervening elements present. The inquiry unit 203 may provide the selected questions to the user through the user terminal connected to the hearing device 201. In one example, the user terminal may be a terminal that the user may freely carry and use. As a non-exhaustive illustration only, the user terminal described herein may refer to a mobile device such as a cellular phone, a personal digital assistant (PDA), a digital camera, a portable game console, and an MP3 player, a portable/personal multimedia player (PMP), a handheld e-book, a portable lab-top PC, and devices such as a desktop PC, a high definition television (HDTV), an optical disc player, a setup box, and the like capable of wireless communication or network communication consistent with that disclosed herein. Also, the user terminal may be a device configured to display the questions provided by the hearing device 201. When provided with the questions from the hearing device 201, the user terminal displays or audibly provides the questions to the user through a notification function.

For example, as a result of ambient noise, when the questions are not successfully provided to the user through the audio sensor, the inquiry unit 203 transmits the same questions corresponding to the external environment of the user to the user terminal. In this case, the user may recognize the change of the external environment by checking the user terminal and based on the questions. The user may respond to the questions through the user terminal.

In accordance with an illustrative example, the parameter set unit 204 sets parameters of the hearing device based on the response from the user to the questions and hearing loss information of the user. That is, the parameter set unit 204 sets the parameters of the hearing device, including volume control, equalizer control, volume control at a particular frequency band, noise control, reverberation control, acoustic feedback control, wind noise control, microphone power control, connection to an electronic device, and preset.

For example, the parameter set unit 204 determines the external environment surrounding the user related to wind noise that may be generated when the user is near a window or between buildings, and, accordingly, controls or compensates for the wind noise of the hearing device corresponding to the external environment. In addition, the parameter set unit 204 determines the external environment surrounding the user related to vibration generated when a sound leaking from a receiver of the hearing device fails to return to a transmitter of the hearing device. Accordingly, the parameter set unit 204 controls or compensates for audio feedback of the hearing device 202 corresponding to the external environment.

The parameter set unit 204 minimizes user inconvenience of directly setting the parameters with respect to changes in the external environment, by setting the parameters of the hearing device 202 based on the response of the user.

The external environment determination unit 202, the inquiry unit 203, and the parameter set unit 204 described herein may be implemented using hardware components. The hardware components may include, for example, controllers, sensors, processors, generators, drivers, and other equivalent electronic components. The hardware components may be implemented using one or more general-purpose or special purpose computers, such as, for example, a processor, a controller and an arithmetic logic unit, a digital signal processor, a microcomputer, a field programmable array, a programmable logic unit, a microprocessor or any other device capable of responding to and executing instructions in a defined manner. The hardware components may run an operating system (OS) and one or more software applications that run on the OS. The hardware components also may access, store, manipulate, process, and create data in response to execution of the software. For purpose of simplicity, the description of a processing device is used as singular; however, one skilled in the art will appreciated that a processing device may include multiple processing elements and multiple types of processing elements. For example, a hardware component may include multiple processors or a processor and a controller. In addition, different processing configurations are possible, such a parallel processors.

Figure 3:
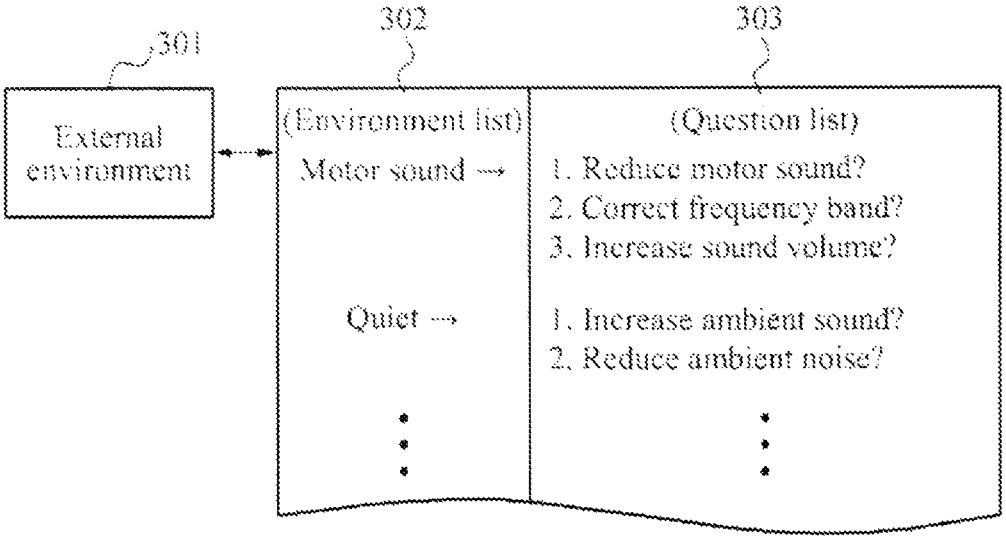
FIG. 3 is a diagram illustrating an example of a process to select questions from a predetermined question list according to an external environment surrounding a user, in accord with an embodiment.

FIG. 3 illustrates an example process of selecting questions from a predetermined question list 303 according to an external environment surrounding a user being determined.

Referring to FIG. 3, the question list 303 includes a plurality of questions corresponding to an external environment 301.

The external environment 301 refers to environmental factors that may occur in a location surrounding the user. For example, the external environment 301 may include noise from a construction site, noise from vehicles, noise from outdoor commercials, frequency noise, and/or noise from a crowded environment, in the location surrounding the user. The external environment 301 may also include time, season, external temperature, weather, and precipitation that affect the external conditions of the user. In addition, the external environment 301 may include indoor locations or outdoor locations.

The question list 303 may be a list of questions corresponding to the external environment of the user. For example, with respect to a turbo sound existing in the external environment, the question list 303 may include a plurality of questions such as 'Reduce turbo volume?', 'Correct frequency band?', and 'Increase frequency?'

Also, the question list 303 may include questions considering time, season, external temperature, and weather at a point in time at which the external environment of the user is determined. For example, the question list 303 may include questions considering time, season, external temperature, and weather, such as 'Cicadas singing loudly because it is Summer.' The question list 303 may include questions such as 'Reduce cicada sound?', 'Outside is quiet because it is evening. Increase sound volume?'.

In one illustrative example, an environment list 302 is a list of the external environments 301 that may occur at surrounding the user. The environment list 302 may include external environments of the user, such as 'turbo engine sound', 'quiet', 'wind noise', and 'echo sound'. The environment list 302 is matched with the question list 303, which includes questions that correspond to each of the external environments included in the environment list 302. Contents of the environment list 302 may be added, deleted, or modified as circumstances require.

Figure 4:
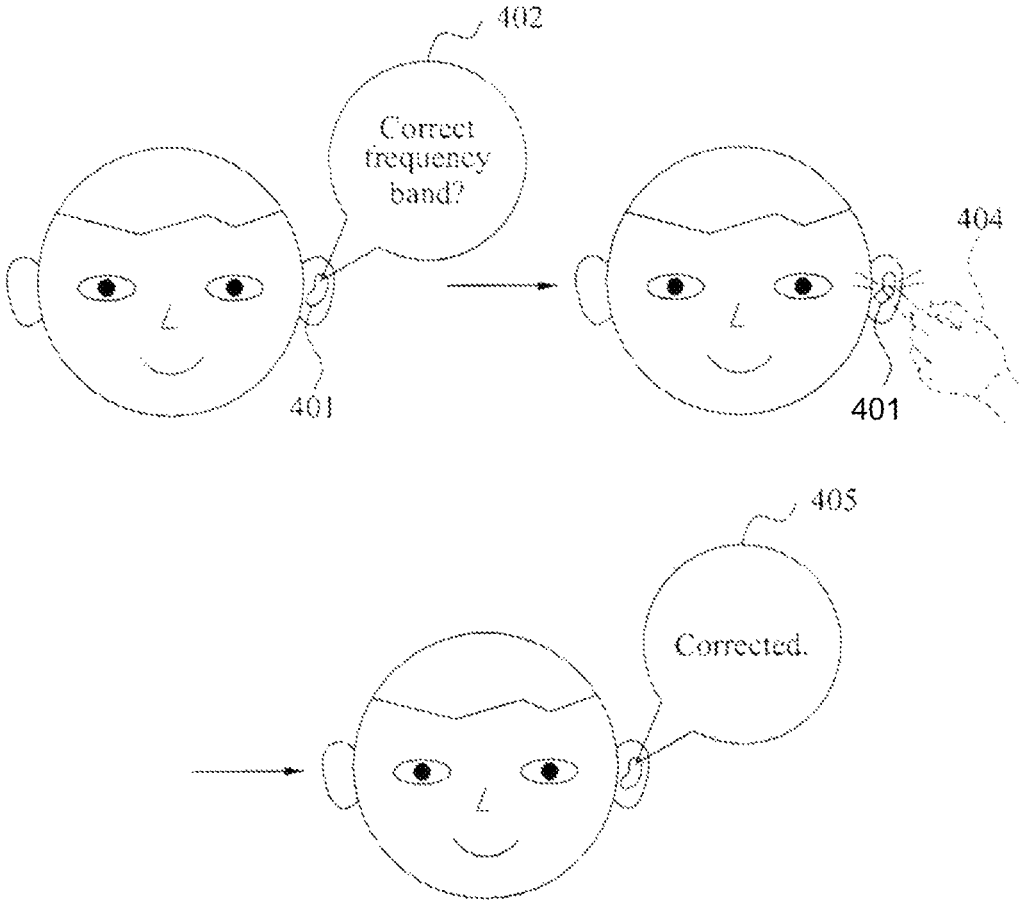
FIG. 4 is a diagram illustrating an example of operation of responding using a touch sensor included in the hearing device, in accord with an embodiment.

FIG. 4 illustrates an example of operation of responding using a touch sensor included in a hearing device 401, in accord with an embodiment.

Referring to FIG. 4, the hearing device 401 may be attached or mounted to a body of a user. In accordance with an illustrative example, the hearing device 401 processes and determines a change in an external environment surrounding the user from an external environment previously used to calibrate the hearing device 401. In response to the determined change, the hearing device 401 transmits to the user a question 402 corresponding to the external environment surrounding the user. The hearing device 401 inquires or presents the question 402 to the user through a sound from the hearing device 401 using an audio sensor included in the hearing device 401. For example, the hearing device 401 provides the user with the question 402, such as 'Correct frequency band?', using the audio sensor included in the hearing device 401. Because the question 402 corresponding to the external environment is provided through the audio sensor included in the hearing device 401, the user may feel comfortable with the hearing device 401.

The user recognizes the question 402 related to the external environment of the user from the hearing device 401 and responds to the hearing device 401 in relation to the question 402. The hearing device 401 receives the response to the question 402 from the user through the touch sensor included in the hearing device 401. For example, the hearing device 401 receives the response to the question, for example, by pressing 404 the touch sensor included in the hearing device 401 for a predetermine time. In addition, the hearing device 401 may receive the response to the question by tapping 404 the touch sensor for a predetermined time period. In the alternative, the hearing device 401 may receive the response to the question by triggering the touch sensor wirelessly through a voice command from the user. The voice command may be a pre-programmed or pre-set command or password that would trigger the touch sensor to be enabled to receive the response to the question.

Additionally, the hearing device 401 may set parameters of the hearing device 401 and then provide a setting result to the user. For example, the hearing device 401 sets the parameters of the hearing device 401 related to a frequency band based on the response to the provided question 402 and hearing loss information of the user, and then provides the result such as 'Correction is completed.'

Figure 5:
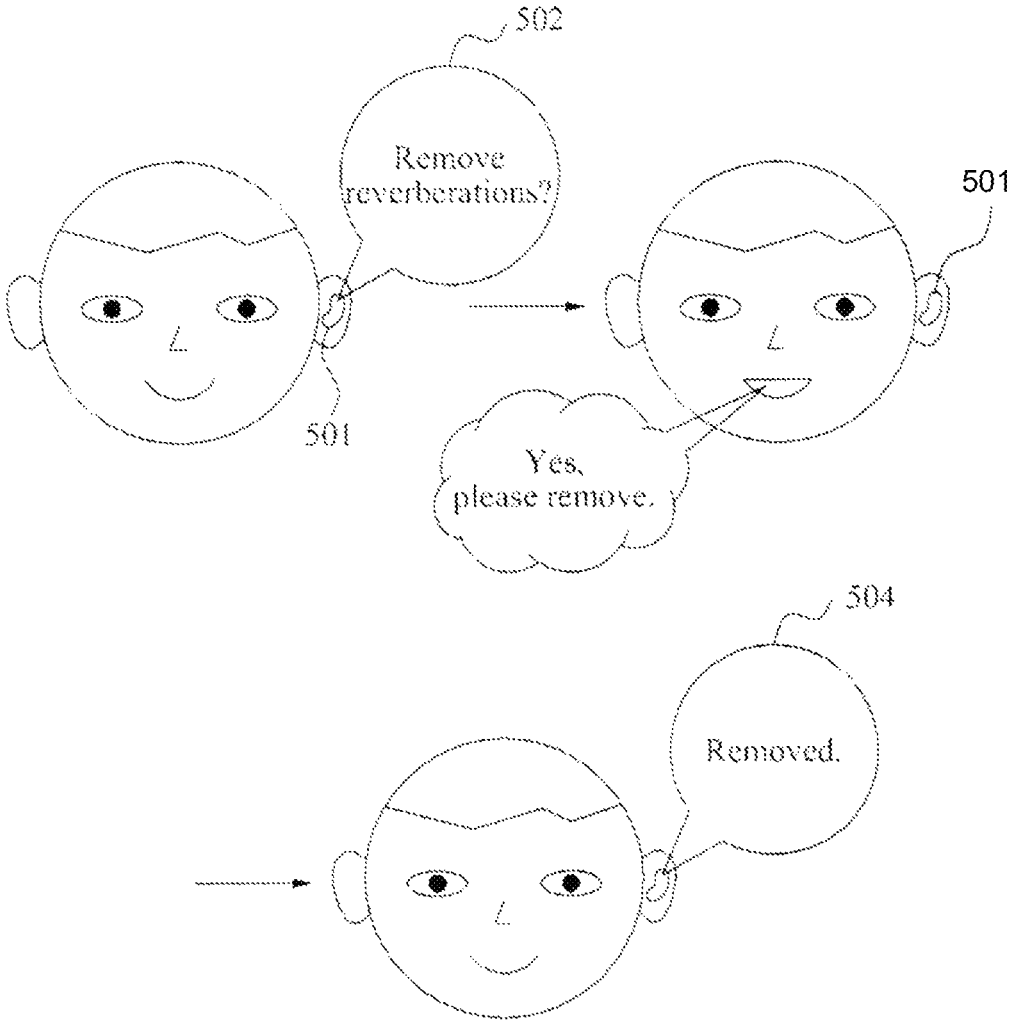
FIG. 5 is a diagram illustrating an example of operation of responding using a voice of the user, in accord with an embodiment.

FIG. 5 is a diagram illustrating an example of operation of responding using a voice of a user, in accord with an embodiment.

Referring to FIG. 5, a hearing device 501 may be attached or mounted to a body of a user. In accordance with an illustrative example, the hearing device 501 processes and determines a change in an external environment surrounding the user from an external environment previously used to calibrate the hearing device 501. In response to the determined change, the hearing device 501 transmits to the user a question 502 corresponding to an external environment of the user. The hearing device 501 inquires or presents the question 502 to the user using an audio sensor included in the hearing device 501. For example, the hearing device 501 may inquire or present the user with the question 502 such as 'Remove reverberations?' using the audio sensor included in the hearing device 501. In one example, because the question 502 corresponding to the external environment is provided through the audio sensor included in the hearing device 501, the user may feel comfortable with the hearing device 501.

The user recognizes the question 502 transmitted from the hearing device 501 and responds to the hearing device 501 in relation to the question 502 using the audio sensor included in the hearing device 501. In one example, a particular frequency of the voice of the user may be pre-stored in the hearing device 501. For example, the user may make a response such as 'Yes, please remove.' to the question 502 corresponding to the external environment. The hearing device 501 receives the particular frequency from the user using the audio sensor. For instance, the user responds to the hearing device 501 through various response methods including the foregoing example illustrated in FIG. 5. In the alternative, the hearing device 501 may receive the response to the question by triggering the touch sensor wirelessly through a voice command from the user. The voice command may be a pre-programmed or pre-set command or password that would trigger the touch sensor to be enabled to receive the response to the question.

The hearing device 501 may set parameters of the hearing devices based on the response of the user and hearing loss information of the user. That is, the hearing device 501 may set the parameters such as volume control, equalizer control, control of a particular frequency band, noise control, reverberation control, wind noise control, acoustic feedback control, and the like, according to the response of the user.

For example, the hearing device 501 may determine an external environment related to an uneven frequency, and adjust an equalizer of the hearing device 501 corresponding to the external environment. In addition, the hearing device 501 determines an external environment related to sound reverberations generated from wind reflections on ambient objects, and control or remove the reverberations corresponding to the external environment. That is, the hearing device 501 sets the parameters of the hearing device 501 related to oscillation frequency, and frequency, corresponding to the external environment.

In addition, the hearing device 501 may set the parameters and then provide the setting result to the user. For example, the hearing device 501 may set parameters related to reverberations based on the response from the user and the hearing loss information of the user, and provide the result such as 'Removed.'

Figure 6:
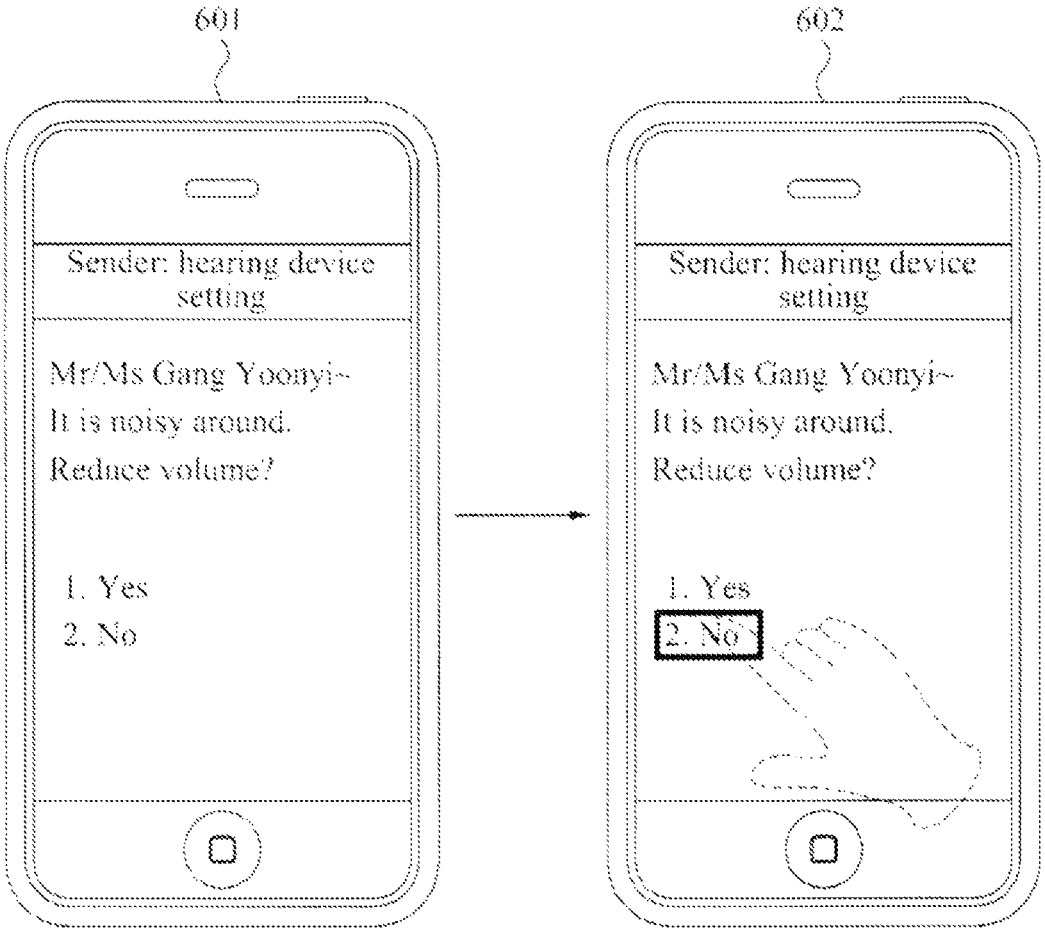
FIG. 6 is a diagram illustrating an example of operation of responding using a user terminal, in accord with an embodiment.

FIG. 6 is a diagram illustrating an example of operation of responding using a user terminal 601, in accord with an embodiment.

Referring to FIG. 6, the user terminal 601 connected to a hearing device receives a question corresponding to an external environment surrounding a user of the hearing device. The user terminal 601 displays the question and the user may check the displayed question.

The user may check the question transmitted from the hearing device through a user terminal 602. Also, the user may respond to the question using the user terminal 602. For example, the user may check the transmitted question through the user terminal 602 and respond to the question from the hearing device by selecting or touching a response expressing an intention or response from the user. As another example, the user may check the question using the user terminal 601 and respond to the question using an audio sensor or a touch sensor included in the hearing device.

Figure 7:
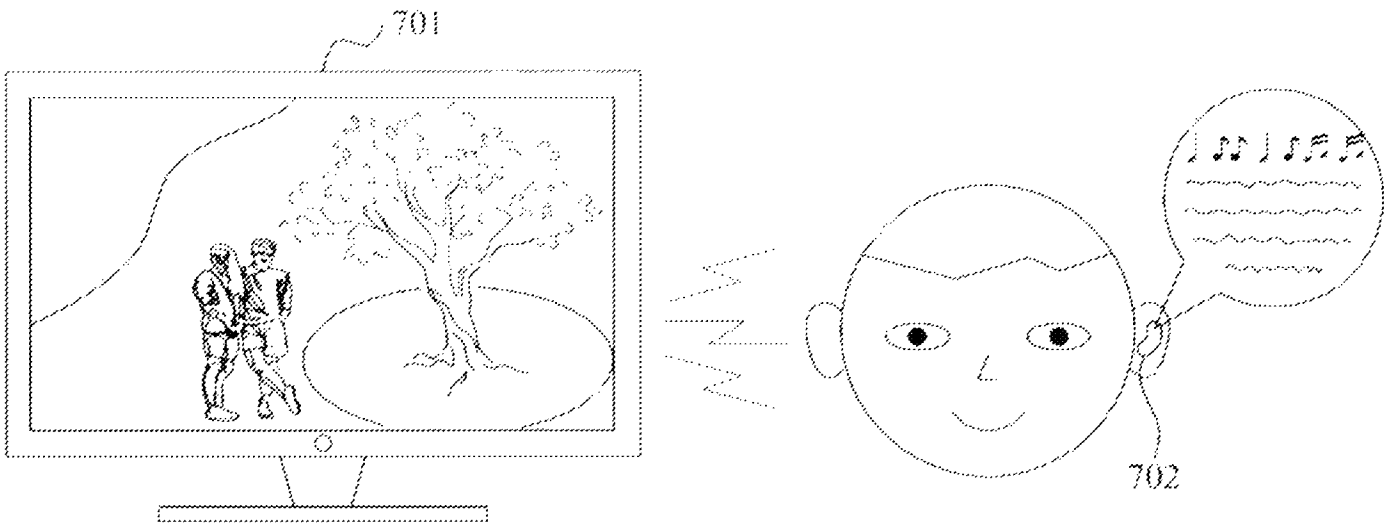
FIG. 7 is a diagram illustrating an example of operation of connecting with an electronic device according to an intensity of detected electronic waves, in accord with an embodiment.

FIG. 7 is a diagram illustrating an example of operation of connecting with an electronic device 701 according to intensity of detected electronic waves, in accord with an embodiment.

Referring to FIG. 7, a hearing device 702 detects radio waves from the electronic device 701 located in the external environment near the user. The hearing device 702 may include a sensor to detect the radio waves. The hearing device 702 detects various intensities of radio waves according to a distance between the user and the electronic device 701. That is, when the hearing device 702 is adjacent to the electronic device 701, the hearing device 702 detects radio waves with high intensity from the electronic device 701. The radio waves with high intensity refer to radio waves having a maximum value that the electronic device 701 may emit. When the hearing device 702 and the electronic device 701 are not adjacent to each other, the hearing device 702 detects radio waves of low intensity from the electronic device 701. In one example, the radio waves of low intensity refer to radio waves having a minimum value that the electronic device 701 may emit. However, the embodiments are not to be interpreted in a limiting manner because the intensity of the radio waves may be different according to a type of the electronic device 701.

The electronic device 701 may include feature information including different radio waves in accord with various types of electronic devices, including the electronic device 701. Therefore, the hearing device 702 may classify the electronic devices using the feature information of the detected radio waves.

In addition, the hearing device 702 may select questions according to intensity of the detected radio waves. For instance, when the hearing device 702 is adjacent to the electronic device 701 and detects radio waves of high intensity, the hearing device 702 may select questions to optimize the sound through the hearing device 702 received from the electronic device 701. For example, the hearing device 702 may check the electronic device 701 through the feature information of the detected radio waves, and select questions corresponding to the electronic device 701, the questions such as 'TV is proximate. Connect with TV?', 'Connect with radio?', 'Connect with desktop?', and the like.

The hearing device 702 may provide the selected questions through the user terminal, which is associated with an audio sensor or the hearing device 702. The hearing device 702 may set parameters based on a response to the questions and hearing loss information of the user, and then connect with the electronic device 701. The hearing device 702 may include a separate sensor configured to receive a sound in connection with the electronic device 701, besides the sensor configured to receive an external sound.

In addition, the hearing device 702 transmits the sound from the electronic device 701 connected with the hearing device 702 to the user using the separate sensor. The hearing device 702 may interrupt the sound from a speaker of the electronic device 701 through the connection with the electronic device 701. Also, the hearing device 702 enables the sound to be output from the electronic device 701 through the separate sensor. That is, the hearing device 702 may include an algorithm to control the sound of the electronic device 701.

For example, the hearing device 702 may be connected to a TV disposed in the external environment surrounding the user, and interrupt a TV sound or allow output of the TV sound through the separate sensor.

When connected with the electronic device 701, the hearing device 702 controls power of the sensor configured to receive the external sound, such as the audio sensor or a microphone. For example, the hearing device 702 connected with a radio provides the user with questions for turning on and off the sensor receiving the external sound. Accordingly, the hearing device 702 may control power of the sensor receiving the external sound according to a response to the questions.

The questions related to power control of the sensor may be inquired in consideration of user convenience, for example, when the user is alone or when the user is with other people, but wants to concentrate on the electronic device.

As another example, the hearing device 702 may be connected with another hearing device 702 disposed around the user. For instance, the hearing device 702 may be positioned in one ear of the user and the other hearing device 702 may be positioned in another ear of the user. In the alternative, the other hearing device 702 may be a hand held device. In one example, the different hearing devices 702 may be correlated through a social network service (SNS). In addition, unique frequencies for identification may be pre-stored in the different hearing devices 702 to be connected with each other.

Therefore, the hearing device 702 may be connected with another hearing device 702 by correcting the unique frequency. Also, the hearing device 702 may be connected with another hearing device 702 through various connection methods such as streaming.

The hearing device 702 may receive the pre-stored unique frequency at a location of the user. The hearing device 702 may check the pre-stored unique frequency, select questions about whether to connect with another hearing device 702 that corresponds to the unique frequency, and transmit the questions to the user. In addition, the hearing device 702 may be connected to another hearing device 702 by correcting a frequency band corresponding to the frequency. Accordingly, the hearing device 702 may receive a sound from another hearing device 702.

The function of connecting with another hearing device 702, as described above, may be useful when the user is dropped out of a party in a crowded place, for example during a party or a trip.

Figure 8:
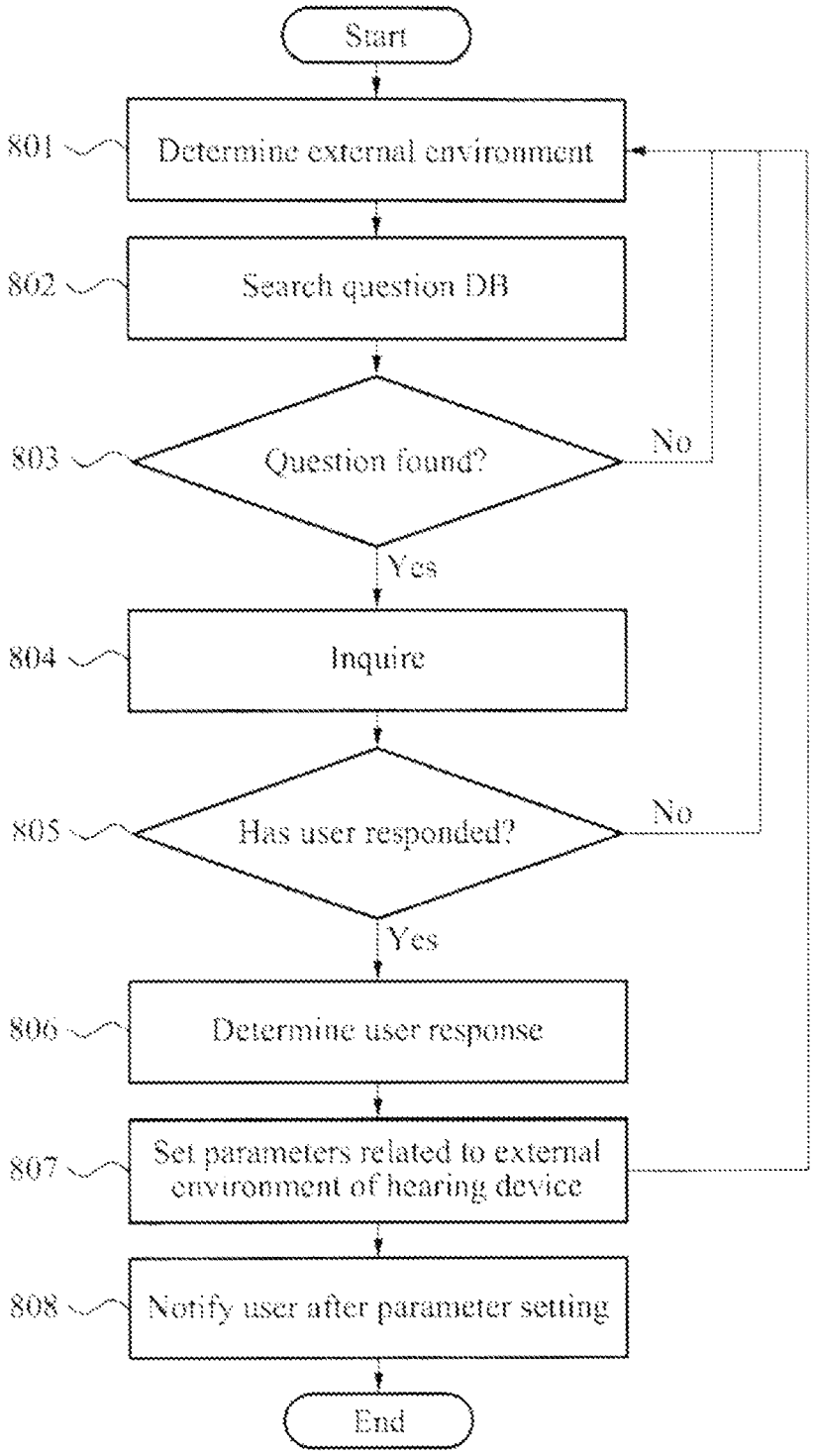
FIG. 8 is a flowchart illustrating an example an operational process of a hearing device, in accord with an embodiment.

FIG. 8 is a flowchart illustrating an example of a process performed by a hearing device, in accord with an embodiment.

In operation 801, the process of the hearing device determines an external environment surrounding a user using an audio sensor. The process of the hearing device may use an acceleration sensor, a temperature sensor, an optical sensor, and the like, besides the audio sensor, to determine the external environment of the user.

In operation 802, the process of the hearing device may search questions corresponding to the external environment surrounding the user. That is, the process of the hearing device searches the questions corresponding to the external environment surrounding the user, from a DB including a predetermined question list.

In operation 803, the process of the hearing device finds questions corresponding to the external environment from the question list. The questions may be found based on, as a function of, or considering factors influencing a sound of the user, for example, a user gender, a user age, a point of time at which the external environment of the user is determined, and a temperature. For example, when corresponding questions are absent in the question list, the process of the hearing device may add and select the corresponding questions.

In operation 804, the process of the hearing device inquires the selected questions to the user. The process of the hearing device inquires the questions using the audio sensor included in the hearing device. In addition, the hearing device may inquire the selected questions using a user terminal compatible with the hearing device.

In operation 805, the process of the hearing device receives a response to the questions from the user. In one example, the process of the hearing device uses the audio sensor or a touch sensor included in the hearing device to receive the response from the user. Furthermore, the hearing device may receive the response from the user through a user terminal connected with the hearing device.

In operation 806, the process of the hearing device determines the response received from the user. For example, the process of the hearing device receives the response expressing the user intention with respect to the questions.

In operation 807, the process of the hearing device may set parameters related to the external environment of the hearing device, corresponding to the response received from the user. The process of the hearing device sets the parameters related to the external environment based on the response from the user to minimize user inconvenience of directly setting the parameters with respect to the external environment being changed.

In operation 808, the process of the hearing device sets the parameters related to the external environment based on the response from the user and hearing loss information of the user, and then provides the user with the setting result.

It is to be understood that in the embodiment of the present invention, the operations in FIG. 8 are performed in the sequence and manner as shown although the order of some steps and the like may be changed without departing from the spirit and scope of the present invention. In accordance with an illustrative example, a computer program embodied on a non-transitory computer-readable medium may also be provided, encoding instructions to perform at least the process described in FIG. 8.

Program instructions to perform a method described in FIG. 8, or one or more operations thereof, may be recorded, stored, or fixed in one or more non-transitory computer-readable storage media. The program instructions may be implemented by a computer. For example, the computer may cause a processor to execute the program instructions. The media may include, alone or in combination with the program instructions, data files, data structures, and the like. Examples of computer-readable media include magnetic media, such as hard disks, floppy disks, and magnetic tape; optical media such as CD ROM disks and DVDs; magneto-optical media, such as optical disks; and hardware devices that are specially configured to store and perform program instructions, such as read-only memory (ROM), random access memory (RAM), flash memory, and the like. Examples of program instructions include machine code, such as produced by a compiler, and files containing higher level code that may be executed by the computer using an interpreter. The program instructions, that is, software, may be distributed over network coupled computer systems so that the software is stored and executed in a distributed fashion. For example, the software and data may be stored by one or more computer readable recording mediums. Also, functional programs, codes, and code segments for accomplishing the example embodiments disclosed herein may be easily construed by programmers skilled in the art to which the embodiments pertain based on and using the flow diagrams and block diagrams of the figures and their corresponding descriptions as provided herein.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents.

Accordingly, other implementations are within the scope of the following claims.

What is claimed is:

1. A hearing device, comprising:

an external environment determination unit configured to determine an external environment currently surrounding a user wearing the hearing device, using a radio wave sensor included in the hearing device;

an inquiry unit configured to select a question in response to the external environment currently surrounding the user and to inquire the question to the user; and a parameter set unit configured to set a parameter of the hearing device based on a response to the question and hearing loss information of the user, wherein the inquiry unit is further configured to classify an electronic device disposed in the external environment currently surrounding the user using radio waves detected by the radio wave sensor and select a question of whether to connect to the classified electronic device and receive sound, through the radio wave sensor, from the classified electronic device, according to intensity of radio waves detected from the electronic device.

2. The hearing device of claim 1, wherein the external environment comprises any one or any combination of two or more of oscillation frequency, frequency, and electronic waves generated in the external environment currently surrounding the user.

3. The hearing device of claim 1, wherein the external environment determination unit is further configured to determine the external environment currently surrounding the user using an audio sensor included in the hearing device.

4. The hearing device of claim 1, wherein the inquiry unit comprises a question list comprising questions corresponding to the external environment currently surrounding the user.

5. The hearing device of claim 1, wherein the inquiry unit is further configured to select the question considering sound distortions due to influences caused by any one or any combination of two or more of a user gender, a user age, a time zone at which the external environment currently surrounding the user is determined, a season, a weather, and an external temperature.

6. The hearing device of claim 1, wherein the inquiry unit is further configured to inquire the selected question to the user through a user terminal connected to the hearing device or to an audio sensor or a touch sensor included in the hearing device, and to receive the response to the question.

7. The hearing device of claim 1, wherein the parameter set unit is further configured to set the parameter of the hearing device based on any one or any combination of two or more of volume control, equalizer control, volume control at a particular frequency band, noise control, reverberation control, wind noise control, acoustic feedback control, microphone power control, connection to an electronic device, and preset.

8. A method for a hearing device, comprising:

determining an external environment currently surrounding a user wearing the hearing device, using a radio wave sensor included in the hearing device;

selecting a question in response to the external environment currently surrounding the user and inquiring the question to the user; and setting a parameter of the hearing device based on a response to the question and hearing loss information of the user, wherein the selecting and inquiring of the question comprises classifying an electronic device disposed in the external environment currently surrounding the user using radio waves detected by the radio wave sensor and selecting a question of whether to connect to the classified electronic device and receive sound, through the radio wave sensor, from the classified electronic device, according to intensity of radio waves detected from the electronic device.

9. The method of claim 8, wherein the external environment comprises any one or any combination of two or more of oscillation frequency, frequency, and electronic waves generated in the external environment currently surrounding the user.

10. The method of claim 8, wherein the determining of the external environment comprises determining the external environment currently surrounding the user using an audio sensor included in the hearing device.

11. The method of claim 8, wherein the selecting and inquiring of the question comprises using a question list comprising questions corresponding to the external environment currently surrounding the user.

12. The method of claim 8, wherein the selecting and inquiring of the question comprises selecting the question considering sound distortions due to influences caused by any one or any combination of two or more of a user gender, a user age, a time zone at which the external environment currently surrounding the user is determined, a season, a weather, and an external temperature.

13. The method of claim 8, wherein the selecting and inquiring of the question comprises inquiring the selected question to the user through a user terminal connected to the hearing device or to an audio sensor or a touch sensor included in the hearing device, and to receive the response to the question.

14. The method of claim 8, wherein the setting of the parameter comprises setting the parameter of the hearing device based on any one or any combination of two or more of volume control, equalizer control, volume control at a particular frequency band, noise control, reverberation control, wind noise control, acoustic feedback control, microphone power control, connection to an electronic device, and preset.

15. A non-transitory computer readable medium storing instructions that, when executed by a processor, cause the processor to perform the method of claim 8.

* * * * *